US005373673A

United States Patent [19]

Albritton et al.

[11] Patent Number: 5,373,673

[45] Date of Patent: Dec. 20, 1994

[54] STRUCTURAL JOINT

[75] Inventors: Charles W. Albritton, Hermitage, Pa.; Richard G. Blasko, Hubbard, Ohio; Charles D. Reagle, Mercer, Pa.

[73] Assignee: Thomas & Betts Holdings, Inc., Memphis, Tenn.

[21] Appl. No.: 120,182

[22] Filed: Sep. 13, 1993

Related U.S. Application Data

[63] Continuation of Ser. No. 825,819, Jan. 21, 1992, abandoned, which is a continuation of Ser. No. 476,987, Feb. 8, 1990, abandoned.

[51] Int. Cl.[5] ..... E04B 2/00; E04C 2/00; E04C 3/00

[52] U.S. Cl. ..... 52/276; 52/270; 52/558.1; 52/730.4; 52/730.6

[58] Field of Search ..... 52/261, 270, 272, 276–279, 52/282.3, 288, 730.4–730.6, 588, 288.1, 588.1

[56] References Cited

U.S. PATENT DOCUMENTS

| | | | |
|---|---|---|---|
| 364,044 | 5/1887 | Sagendorph | 52/278 |
| 1,063,514 | 6/1913 | Detwiler | 52/270 |
| 1,980,347 | 11/1934 | Miller et al. | 52/276 X |
| 2,229,775 | 1/1941 | Sherron | 52/275 X |
| 2,993,637 | 7/1961 | Lacey | 52/276 X |
| 3,127,960 | 4/1964 | Smith et al. | 52/630 X |
| 3,304,676 | 2/1967 | Sallie et al. | 52/276 |
| 3,355,852 | 12/1967 | Lally | 52/270 X |
| 3,623,784 | 11/1971 | Neufeld | 52/275 X |
| 3,698,147 | 10/1972 | Sikes | 52/276 |
| 4,196,553 | 4/1980 | Veach | 52/276 |
| 4,676,039 | 6/1987 | Leiter et al. | 52/588 X |
| 5,260,525 | 11/1993 | Morse | 52/272 X |

*Primary Examiner*—Carl D. Friedman
*Assistant Examiner*—Robert J. Canfield
*Attorney, Agent, or Firm*—William Squire

[57] ABSTRACT

A plurality of planar walls for a HVAC enclosure enclose an interior volume subjected to negative pressure which pressure tends to draw undesirable contaminants into the volume through fastener apertures used to attach the walls together. A corner joint construction for the enclosure includes inner and outer L-shaped members formed with tortuous engaged end extensions. The members cooperate to form an L-shaped volume for the length of each corner joint of the enclosure and an end chamber also extending for the length of the joint is formed by the extensions at each L-shaped volume leg edge. The L-shaped volume and the end chambers isolate the outermost member from interior volume. Fasteners used to fasten the walls to the corner joint are fastened in communication with the end chambers or the L-shaped volume to isolate the interior volume from the fastener apertures.

12 Claims, 2 Drawing Sheets

SEE FIG. 5

STRUCTURAL JOINT

This is a continuation of application Ser. No. 07/825,819 filed Jan. 21, 1992 abandoned, which is a continuation of Ser. No. 476,987, filed Feb. 8, 1990, abandoned.

BACKGROUND OF THE INVENTION

1. Field of the Invention

The present invention relates to structural joints, and, more particularly, to improved joint structures for enclosures, particularly those fabricated from sheet metal.

2. Description of the Prior Art

Enclosures for equipment and mechanisms are quite common. An enclosure may serve one or more protective functions, including preventing personnel from coming into contact with potentially hazardous items within the enclosure and preventing noxious substances within the enclosure from escaping into the surrounding environment.

Aside from such protective functions, equipment enclosures at times also perform functions in aid of, or necessary to, the function of the contained equipment. For example, in the case of HVAC equipment which includes fans or blowers, an enclosure both prevents personnel from contacting rotating members and defines and encloses a volume. The enclosure permits the fan or blower to maintain the enclosed volume at a negative or positive pressure. Ducts or the like connected to the enclosure are thus able to conduct air to or from the enclosure due to the action of the fan or blower.

In some HVAC equipment configurations an enclosure may surround a burner, various damper structures and a blower. Often the output of the blower is run through a wall of the enclosure and directly connected to ducts which carry air at a positive pressure which has been heated by the burner. The return ducts carrying air to the burner to be heated thereby are connected directly to the enclosure for communication with the interior thereof. The interior of the housing is in direct communication with the input side of the blower, and is, accordingly, maintained at a negative pressure.

If the enclosure is not integral, or if joints between various structural members thereof, as well as connections to ducts, are not well sealed, the negative pressure maintained within the interior of the enclosure will tend to draw into the enclosure undesirable substances. In indoor environments, such substances include water vapor; in outdoor environments, such substances include liquid water from rain and other precipitation. The corrosive and other deleterious effects of water are well known as are the benefits of excluding water from the interior of the enclosure. Other corrosive or deleterious substances, such as gases or solvents, may also be drawn into the enclosure by a negative pressure therewithin.

Enclosures surrounding the fans, blowers or other elements of HVAC equipment must also be robust. They must be able to withstand the positive or negative pressures maintained therewithin and to provide firm, rigid mounting environments for the fans and blowers, as well as for burners, ductwork and other items associated with the HVAC equipment.

Typically, enclosures of the type discussed above are fabricated from pieces of sheet metal which are connected together at and by joint structures. Ideally, these joint structures should permit the sheet metal to be attached thereto in a manner which, with a minimum of effort and expense, minimizes or eliminates infiltration of water and other substances into the enclosure. Further, the joint structures should also permit the expedient construction of a robust enclosure.

SUMMARY OF THE INVENTION

A primary object of the present invention is the provision of an improved corner joint structure for an enclosure, such as an enclosure used with HVAC equipment and containing a fan or blower.

Another object of the present invention is the provision of a corner joint structure as aforesaid which minimizes or eliminates infiltration of deleterious substances past the joint and into the enclosure when the volume enclosed thereby is maintained at a negative pressure.

Yet another object of the present invention is the provision of an improved corner joint structure as aforesaid which is easy to use and permits the construction of a structurally robust enclosure.

With these and other objects in view, the present invention contemplates an improved corner joint structure for an enclosure. The enclosure surrounds a volume and, in environments such as those found in HVAC equipment, the volume is subjected to negative pressure.

The enclosure is constituted of planar wall members, which may be sheet metal. Mechanical fasteners passing through the wall members and the corner joint structure connect them together. Negative pressure maintained within the volume tends to draw deleterious substances—such as water—into the surrounded volume through the points of passage of the fasteners.

The improved corner joint structure comprises two members, an inside corner members and an outside corner member.

The inside corner member is complexly and reflexively shaped. When viewed end on, the shape defines a non-obtuse angle portion having two integral arms. Between ends of the arms the portion has an inwardly facing non-obtuse angle—including side and an outwardly facing side. Preferably, the non-obtuse angle is 90°. Each arm bears at its end a generally U-shaped section. Each U-shaped section is generally located on the outwardly facing side. A terminus of a first leg of the U is continuous with the end of its associated arm. A second leg of the U is normal to its associated arm with its terminus spaced from the arm. A gap is defined between the terminus of the second leg of the arm. The bridge between the legs of the U is generally parallel to the associated arm.

The outside corner member is complexly shaped. When viewed end on, it defines a non-obtuse angle segment having two integral projections. The segment has, between its ends, an inwardly facing non-obtuse angle—containing side and an outwardly facing side. At the free end of each extension there is a first extension and a second extension. The first extension is normal to and continuous with its associated projection and extends along the other projection. The second extension is normal to and continuous with its associated first extension and extends away from its associated projection.

The members are telescoped together forming a mechanically rigid structure. Telescoping is achieved by inserting each second extension into one of the gaps and relatively moving the members longitudinally. In the assembled corner joint structure, each second extension overlies one of the arms and each first extension overlies one of the second legs. Also, the bridges and the projections define substantially continuous, co-planar surfaces and arm-projection pairs are respectively generally parallel.

Mechanical fasteners pass through either the bridges or the projections to mount the wall members thereon. Since the points of passage of the fasteners through the corner joint structure do not communicate with the enclosed volume, no infiltration of matter or other substances into the volume can take place via the fasteners.

The joint of the present invention may be combined with one or more side walls to produce a side wall subassembly. To facilitate this combination, the substantially co-planar associated bridges and projections are slightly offset from each other in a direction normal to their planes by a distance "X". A planar side wall with a thickness "X" has a flange formed normally along one edge thereof. The flange may be inserted between a first extension and the associated second leg so that the side wall overlies the plane of the associated bridge and is coplanar with the plane of the associated projection. The side wall may be attached to the joint by fasteners which pass therethrough and through the bridge.

The joint may be combined with a top wall into a top wall subassembly. A planar top wall has a normally depending flange. The top wall may be positioned to overlie the end of the joint so that the plane of the flange overlies the planes of a projection and its associated bridge. The top wall may be attached to the joint by fasteners passing through the flange and also through either the projection or the bridge.

The top and side wall subassemblies may be combined, with the plane of the top wall overlying the edge of the side wall and of its flange. The plane of the top wall flange overlies the portion of the side wall which, in turn, overlies the bridge. The fasteners mounting the top wall pass through the side wall where it overlies the bridge.

The joint and a bottom wall may be combined into a bottom wall subassembly. The bottom wall is a ridig robust member having a planar base for the HVAC equipment with a depending skirt around the periphery thereof. An extending flange is formed on the free edge of the skirt, and a support rim on the free edge of the flange is provided to support the bottom wall and equipment thereon on a surface. The bottom wall may be positioned so that the skirt overlies the plane of an arm of the joint, with an end of the arm, as well as the ends of the associated projection, extensions, legs and bridges, all resting on the plane of the bottom wall flange. The bottom wall and the joint may be attached by fasteners which pass through the skirt and the arm between the base and the flange. The points of passage of the fasteners do not communicate with the surrounded volume of the completed enclosure.

A side wall may be added to the bottom wall subassembly. In this event the edge of the side wall flange rests on the plane of the bottom wall flange. The plane of the side wall will overlie the plane of the support rim and is attachable thereto by fasteners passing through both thereof.

Side walls, a bottom wall and a top wall may all be attached to the joint, in the manner described above, to produce an enclosure having no points of entry thereinto via the points of passage of fasteners used to connect the various walls to the joint structure.

BRIEF DESCRIPTION OF THE DRAWINGS

FIGS. 3(*a*) and 3(*b*) are, respectively, plan and front elevations of an inside corner member which is a constituent part of the improved joint of FIGS. 1 and 2;

FIGS. 4(*a*) and (*b*) are, respectively, plan and front elevations of an outside corner member which is a constituent part of the improved joint of FIGS. 1 and 2 and which is assembled with the member of FIG. 3 to produce such joint;

DETAILED DESCRIPTION OF THE INVENTION

Figures 1, 2, 3A, 3B, 4A, 4B:
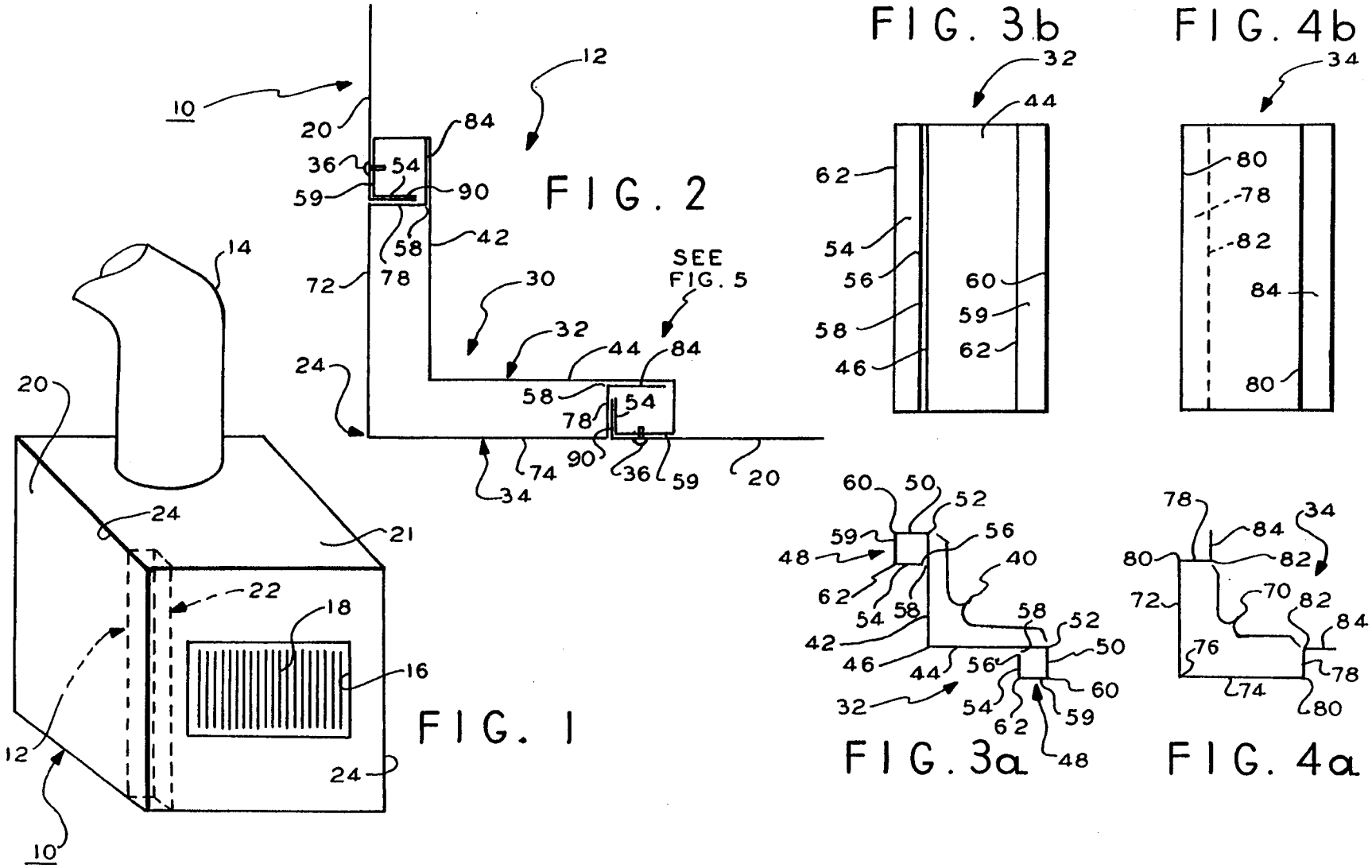
FIG. 1 is front, isometric elevation of an enclosure which includes the improved corner joint structure of the present invention as only generally shown therein.
FIG. 2 is plan view enlargement of a portion of the enclosure of FIG. 1 better showing the improved joint of the present invention.

Referring first to FIG. 1, there is generally depicted an enclosure or cabinet 10. The enclosure 10, which may contain any type and number of mechanisms (not shown), is, for purposes of the present invention, assumed to contain within a volume 12 enclosed thereby HVAC equipment or the like which includes a fan or blower (not shown). The blower pulls air into the volume 12 within the enclosure 10 through an air return duct 14 connected to the enclosure 10. The air pulled into the enclosure 10 is heated by a burner (not shown) or similar facility, and the heated air is blown into an area to be heated by the blower via an air outlet 16 which may be covered by a grid or register 18. The outlet 16 is formed through the enclosure 10 and is directly connected to the output of the blower.

Typically, the enclosure 10 is fabricated from sheet metal which is formed into planar side walls 20 and a top wall 21 mounted together by joint facilities, shown only generally at 22, which may be located, as needed, at and along the twelve corners 24 of the enclosure 10, where it assumes the configuration of a cube or the like. Of course, the enclosure 10 may assume other configurations, as should be obvious. Also typically, where mounting of the walls 20, 21 is achieved by the use of screws (not shown) or similar fasteners, such as rivets, the enclosed volume 12 may experience infiltration of water or other undesirable substances. Such infiltration is caused by application of the negative pressure maintained in the volume 12 by the blower to the points of passage the fasteners through the walls 20.

If the mounting facilities 22 take the form of angle iron (not shown), the infiltration problem is very acute, since the points of passage of the fasteners through the walls 20 and the angle iron communicate directly with the negative pressure within the volume 12. Sealing of these points of passage with a sealant is both time consuming and expensive. Moreover, as the sealant ages, it crack and leaks, necessitating resealing to be undertaken.

If the mounting facilities 22 are hollow, square cross-section posts, some degree of anti-infiltration may be achieved. However, a concomitant increase in cost and loss of interior space are experienced, the latter requiring that the enclosure 10 be made larger than would otherwise be the case.

Specifically, the walls 20 may be mounted to hollow metal posts by butting them up thereagainst and driving fasteners therethrough and through the posts. Since the interior of the hollow posts, into which the fasteners extend, is not in communication with the volume 12 within the enclosure 10, infiltration through the points of passage of the fasteners through the walls and the posts will not occur. Effective sealing of the walls to the posts requires, however, that a substantial area of overlap occur where the walls and posts are butted together. This, in turn, requires that the sides of the already expensive hollow posts have rather large cross-sectional areas, resulting in the posts overall being circumferentially large. This need to use larger, and therefore even more expensive, posts increases the costs of the enclosure 10. Further, the increased size extends into the enclosed volume 12 of the enclosure, leading to either cramped working space within the enclosure 10 or an increase in the size of the enclosure 10 to eliminate this cramping.

Figure 6:
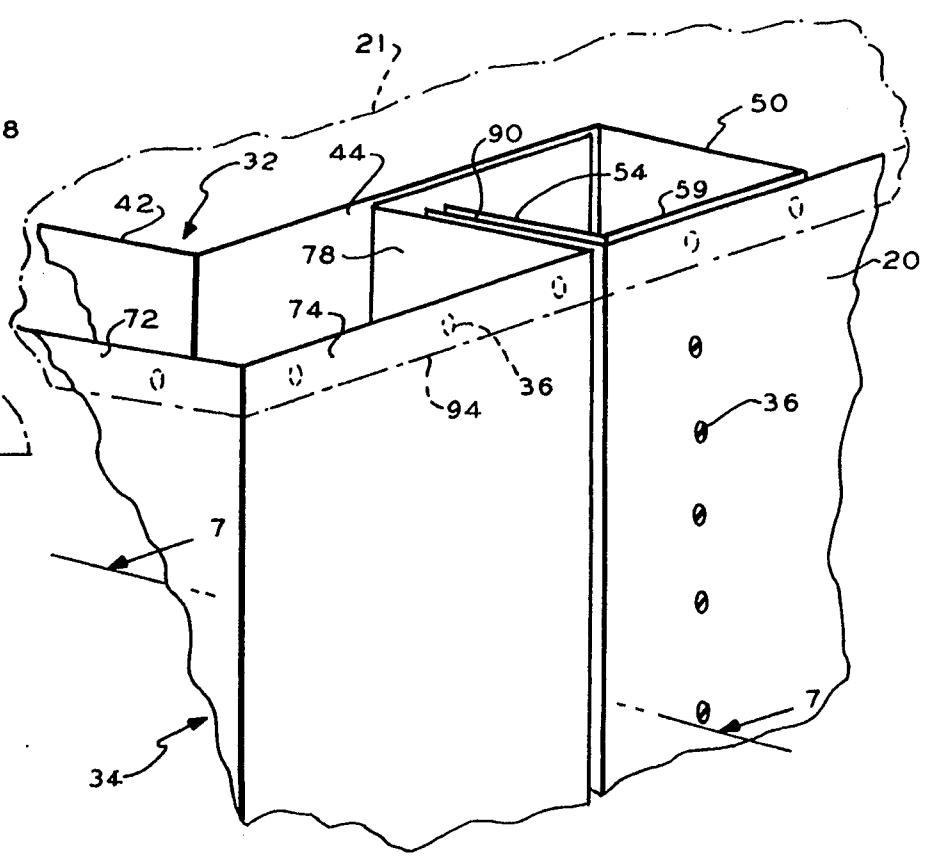
FIG. 6 is an isometric elevation of the joint of the present invention showing in detail the manner of attaching side walls and a top wall to the joint.
Figure 5:
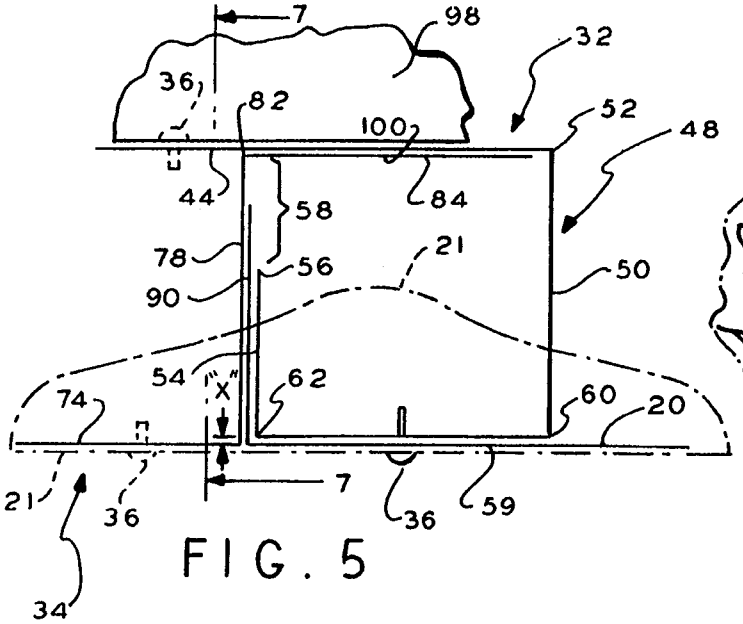
FIG. 5 is an enlargement of a portion of FIG. 2, better illustrating the novel joint hereof and depicting the manner of attaching side, top and bottom walls to the joint to form an enclosure.

Turning now to FIGS. 2, 5 and 6, there is shown a top view of a corner joint structure 30 according to the present invention.

The corner joint structure 30 comprises an inside corner member 32, more fully described with reference to FIG. 3, and an outside corner member 34, more fully described with reference to FIG. 4, which are telescoped together, as shown from the top in FIGS. 2, 5 and 6. After the members 32 and 34 are telescoped together, as more fully set forth below, sheet metal side walls 20 and a top wall 21 are mounted thereto by fasteners 36.

Referring to FIG. 3, the inside corner member 32 comprises a sheet of metal or other structurally robust and formable material, which is formed into the reflexive complex shape depicted. Referring specifically to FIG. 3(*a*), which shows the member 32 end on, the member 32 has a non-obtuse angle portion 40. The non-obtuse angle portion 40 includes two arms 42 and 44 which are integral along a bend 46. Preferably the smaller non-angle between the arms 42 and 44 is a right angle and the larger or obtuse angle therebetween is 270 degrees. As will be appreciated, other angles may be utilized. The non-obtuse angle and the side of the portion 40 on which it is located are inwardly facing, that is, in use they face the inside of the enclosure 10. The larger angle and the side of the portion 40 on which it is located are outwardly facing.

At the end of each arm 42 and 44 remote from the bend 46 is a generally U-shaped section 48, which is generally located on the outwardly facing side of the portion 40. A first leg 50 of each section 48 is normal to and continuous with, along a bend 52, its associated arm 42 or 44. A second leg 54 of each section 48 is normal to its associated arm 42 or 44 with its free end 56 spaced from the arm 42 or 44 to define a gap 58 therebetween. A bridge 59 between and continuous with the legs 50 and 54 along bends 60 and 62, is generally parallel to its associated arm 42 or 44.

Referring now to FIG. 4*a* and 4*b*, the outside corner member 34 is shown as a complexly shaped member fabricated from the same materials as the member 32. The member 34 includes a non-obtuse angle segment 70 having two projections 72 and 74 integral along a bend 76. As with the member 32, the inwardly facing side of the member 34 preferably, but not necessarily, includes an angle of 90 degrees, while the outwardly facing side of the member 34 includes an angle of 270 degrees.

Integrally formed at the end of each projection 72 and 74 is a first extension 78 which is normal to and continuous with its projection 72 or 74 along a bend 80. The extensions 78 are generally parallel to and extend along the opposite projection 74 and 72.

Integrally formed with each first extension 78 along a bend 82 is a second extension 84. The second extensions 84 are normal to their respective first extensions 78 and extend away from the opposite projection 74 and 72.

Again, as best shown in FIGS. 2, 5 and 6, the members 32 and 34 are telescoped together. This is achieved by inserting one end of a member 34 into one end of a member 32 by positioning each second extension 84 in one of the gaps 58 between one arm 42 or 44 and the free ends 56 of the second legs 54, so that each first extension 78 overlies one of the second legs 54. As shown, the bridges 59 and the projections 72 and 74 are nearly coplanar and define a nearly continuous surface against a portion of which one surface of a side wall 20 may be held by a fastener 36. Arm-projection pairs 42-72 and 44-74 are respectively parallel.

In preferred embodiments, the bridges 59 are slightly offset from the projections 72 and 74. As best shown in FIG. 5, the bridges 59 are offset toward the interior of the enclosure 10 by an amount "X" substantially equal to the thickness of the metal from which the side walls 20 are fabricated.

Figure 7:
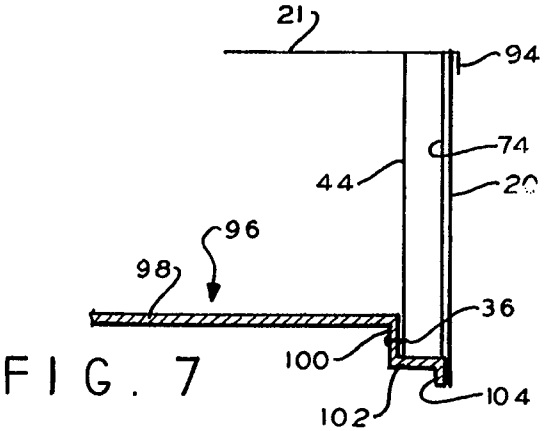
FIG. 7 is a sectional view taken along line 7—7 in FIGS. 5 and 6.

The side walls 20 are planar members. A flange 90 is formed along a bend 92 at ends of the side walls 20 which are to be attached to the joint structure 30. As shown in FIGS. 2, 5 and 7, the flange 90 is insertable between a second leg 54 and its corresponding first extension 78, while the wall 20 overlies and abuts the corresponding bridge 59. Because of the offset "X," the outside surface of the side wall 20 and the adjacent projection 72 or 74 are coplanar and form a continuous surface against which a top wall 21 may be held.

The top wall 21 is a planar member having a depending, peripheral flange 94. The top wall 21 overlies the joints 30 and the side walls 20 with the flange overlying and abutting the projections 72 and 74 and the side walls 20 both at and away from the locations where the side walls 20 overlie the bridges 59.

The passage of the fasteners 36 through the side walls 20 and the bridges 59 do not communicate with the volume 12 enclosed by the enclosure 10. Similarly, fasteners 36 passing through the top wall flange 94, the projections 72, 74, and the bridge 59 do not communicate with the volume 12. Accordingly, water infiltration through these points of passage does not occur. The telescoped and interlocking structure produced by the members 32 and 34 is structurally robust. Further, since the members 32 and 34 may be formed from sheet metal stock, they are less expensive to produce than hollow posts.

FIGS. 5 and 7 depict a bottom wall or base 96 which may be used to close the bottom of the enclosure 10 and to impart further rigidity thereto. The bottom wall or base 96 is preferably heavy gauge metal formed to define a planar base 98 for the HVAC equipment. The bottom wall 96 has a peripheral skirt 100 depending therefrom. The free edge of the skirt 100 carries a flange 102 which in turn carries a peripheral, depending rim 104.

The bottom wall 96 is positioned to locate the base 98 within the walls 20 and 21. The HVAC equipment is preferably mounted to the base 98, and the entire enclosure 10 is supported on the rim 104. The skirt 100 abuts a lower portion of the arms 42 and 44, with the end of the entire joint 30 resting on the flange 102. Fasteners through the skirt 100 and the arms 42 and 44 do not communicate with the interior of the enclosure 12.

In FIG. 2, the disclosed structure forms a number of chambers. The entire enclosure formed by the walls 20 and corner joint structure 30, as well as the top and bottom walls, form an enclosure volume 12, i.e., a first chamber, subject to negative pressure. A corner joint structure 30 formed of inside corner member 32 and outside corner member 34, together with extensions 78, form an elongated angular L-shaped second chamber. This angular second chamber extends in a given direction into and out of the plane of the drawing normal to the drawing plane, FIG. 2. This second chamber has a pair of chamber legs lying in normal planes as apparent in FIG. 2. The extensions 78 are at each end of the legs of this L-shaped chamber for enclosing the chamber ends along the length of these chamber legs in a direction normal to the plane of and into and out of the drawing figure. Thus, the leg ends of the second chamber formed by the structure 30 adjacent to extensions 78, are distal the corner joints formed by the inside corner member 32 and outside corner member 34. These corner joints form edges which are linear and extend in and out of the plane of the drawing figure parallel to the second L-shaped chamber.

At the end of each arm 42 and 44 of the corner members 32 and 34 remote from the bend 46, the U-shaped sections 48 cooperate with the second extension 84 of each projection 72 and 74 of the outer corner member to form enclosed relatively square in transverse section elongated third and fourth chambers. These latter chambers also extend in a direction normal to the drawing sheet, parallel to the second angular chamber formed by the inside and outer corner members. The U-shaped sections 48 at each end of the inside corner member, which form the third and fourth chambers with the outside corner member, lie in the same planes as the corresponding legs of the second angular chamber formed by the inside and outer corner members 32 and 34. Thus, there are three chambers formed by the corner joint structure 30, which is interior the plane of the outer walls 20 of the volume 12. The four chambers thus correspond to the first chamber formed by the volume 12 and to the three chambers formed by the interior of the corner joint structure 30, i.e., the L-shaped chamber formed by the inner and outer corner members 32 and 34, and the end chambers formed by the U-shaped sections 48 at the ends of the legs of the L-shaped angular corner-shaped chamber formed by the inner and outer corner members.

The U-shaped sections 48 forming an interior set of chambers isolate the volume 12 from the external ambient atmosphere. It will thus be apparent that screws 36, which are fastened through the walls of the U-shaped sections 48 chambers at the ends of the inside and outside corner members, communicate only with the third and fourth U-shaped sections 48 chambers at the ends of the legs of the L-shaped chamber and not with the interior volume 12. Thus, the negative pressure of the interior volume 12, the first and primary chamber of the enclosure 10, is not in direct communication with the external region outside of the walls 20 in the presence of fasteners 36 thereby addressing the problem of the negative pressure in the presence of apertures through which the screws pass.

Although certain specific embodiments of the present invention are described in the foregoing detailed description, it should be understood that this invention is not limited to such specific embodiments, but is capable of modification and rearrangement.

I claim:

1. An improved joint structure for an enclosure which forms a volume subjected to negative pressure and which enclosure is fabricated of planar walls, said enclosure including fasteners passing through and attaching together the walls and the joint structure at points of passage therethrough, the negative pressure tending to draw undesirable substances into the formed volume through the points of passage, said joint structure comprising:

(a) an inside corner member, comprising:

(i) angle portion with two arms, said arms being connected at a first joint extending in a given direction to define a first angle, each arm having a first edge spaced from and extending in said given direction, said angle portion having an inwardly facing side and an outwardly facing side, and (ii) at said first edge of and extending along each arm in said given direction and generally located on the outwardly facing side of the angle portion, a generally U-shaped section having a first leg having a second edge, a second leg having a third edge and a bridge disposed between and connected to said first and second legs at the respective second and third edges, said first leg of each U-shaped section extending outwardly from and generally normal to its associated arm at said first edge, the second leg of each U-shaped section being generally normal to its associated arm and having a fourth edge spaced from the bridge and from its associated arm to define a gap between that arm and the second leg, the bridge between the first and second legs of the U-shaped section extending in said given direction and spaced from its associated arm; and (b) an outside corner member comprising:

(i) an angle segment formed by two projections, said projections being connected at a second joint to define a second angle, each projection having a fifth edge spaced from and extending in said given direction, the segment having an inwardly facing side and an outwardly facing side, (ii) said projections each having a first extension generally normal to and extending from said fifth edge of that projection in a direction toward a corresponding different one of said arms of said inside corner member, and (iii) at a sixth edge of each said first extension distal the fifth edge, a second extension generally normal to the first extension and extending in a direction generally away from said second joint;

(c) said inside and outside corner members being telescoped together in interlocked relation wherein each said second extension of said outside corner member is located in a different corresponding one of said gaps of said inside corner member, said inside and outside corner members being juxtaposed in spaced relation such that one arm of the inner member is juxtaposed in spaced relation with one projection of the outer member and the other arm of the inner member is juxtaposed in spaced relation with the other projection of the outer member to form an angular first chamber therebetween extending along said first and second joints in said given direction, said angular chamber comprising third and fourth legs having respective first and second opposite ends distal said joints and extending in said given direction, one of said first extensions enclosing said angular chamber first end and the other first extension enclosing said angular chamber second end, one of said U-shaped sections forming a second chamber wherein the second leg of the that one U-shaped section is juxtaposed with the one extension such that the second chamber is coextensive with the angular chamber third leg, the other of said U-shaped sections forming a third chamber wherein the second leg of that other U-shaped section is juxtaposed with said other extension such that the third chamber is coextensive with the fourth leg of the angular first chamber, said first, second and third chambers being in communication isolation with said formed enclosure volume, whereby said points of passage of fasteners passing through the bridges to attach said enclosure walls thereto do not communicate with said formed volume.

2. The joint structure as set forth in claim 1, wherein: the bridges and projections are planar and the respective corresponding bridge and projection of each of the third and fourth legs of the angular chamber are offset from each other in a direction normal to their planes by a distance "X"; and said joint structure further comprises:

a planar side wall having a plurality of seventh edges and a thickness "X" and a flange along one of said seventh edge, said side wall flange being substantially normal to the plane of said planar side wall and being located between one of said first extensions and its associated juxtaposed bridge second leg so that the planar side wall overlies the plane of the associated juxtaposed second leg bridge and extends away from the latter one first extension and defines a substantially continuous planar surface with that projection corresponding to the latter one first extension, said planar side wall being attached to the joint structure by at least one of said fasteners passing therethrough and through said associated bridge.

3. The joint structure of claim 2 wherein said joint structure has third and fourth opposite ends lying in respective spaced planes normal to said joints and further including:

a planar top wall having a plurality of further edges and a planar flange depending from that top wall along one of said plurality of further edges, the plane of said top wall flange being substantially normal to the plane of said top wall, said planar side wall and said side wall flange each having an additional edge, said top wall being located so that its plane overlies the third end of said joint structure and the additional edges of the side wall flange and the planar side wall so that the plane of the top wall flange overlies both the plane of a projection and a portion of the side wall which overlies the plane of its associated bridge, said top wall being attached to the side wall by at least one fastener passing through the top wall flange and through the projection or through both the side wall and the underlying corresponding bridge.

4. The joint structure of claim 2 wherein said joint structure has third and fourth opposite ends lying in respective spaced planes normal to said joints and further including:

a planar top wall having a plurality of edges and a flange, depending from one of said plurality of top wall edges, the plane of said depending top wall flange being substantially normal to the plane of the top wall, the top wall being located so that its plane overlies the third end of said joint structure and the plane of said depending flange overlies a portion of a projection and the bridge associated with that projection, the top wall being attached to the joint structure by a fastener passing through the top wall flange and through at least one of the projection and the bridge associated with that projection.

5. A joint construction for an enclosure comprising a plurality of enclosure walls defining a first chamber having a negative pressure which pressure tends to cause seepage of foreign substances from ambient atmosphere through apertures passing through said enclosure into said chamber, said apertures for receiving fasteners for attaching said walls together to form said enclosure, said joint construction comprising:

an inner member adapted to form a side wall of said first chamber, said inner member extending in a given direction;

an outer member extending in said given direction and secured to the inner member in spaced juxtaposed relation therewith to form a second chamber therebetween lying in at least one plane, said second chamber extending in said given direction, said outer member forming an external wall of said enclosure, said second chamber having first and second ends extending in said given direction;

a plurality of walls forming third and fourth chambers;

means for securing the third chamber to said inner and outer members at said first end and for enclosing said first end in said given direction, said third chamber extending in said given direction; and means for securing the fourth chamber to said inner and outer members at said second end and for enclosing said second end in said given direction, said fourth chamber extending in said given direction, said third and fourth chambers being coextensive with said second chamber, at least one wall of the third and fourth chambers forming a portion of a wall of said first chamber and at least one other wall of the third and fourth chambers forming an enclosure external wall and being in fluid isolation from said first chamber such that said fastener apertures passing through said at least one other wall for securing at least one of said enclosure walls thereto are in fluid isolation from said first chamber to thereby preclude said seepage.

6. The construction of claim 5 wherein said inner and outer members each comprise sheet material bent at a joint extending in said given direction to subtend an angle whose origin extends in said given direction forming an angular second chamber wherein the inner member has first and second planar arms extending from its joint and the outer member has first and second planar projections extending from its joint, each arm and each projection having first and second parallel edges, the first edges of each member forming said joint of that member.

7. The construction of claim 6 wherein the second edges of the first arm and first projection form the first end and the second edges of the second arm and second projection form the second end, said third chamber comprising bent portions of the inner and outer members extending from the second edges of the first arm and first projection, said fourth chamber comprising bent portions of the inner and outer members extending from the second edges of the second arm and second projection.

8. The construction of claim 7 wherein the bent portions of the outer member include a first extension extending from the outer member second edge towards the first arm of the inner member and a second extension extending from the first extension and juxtaposed with the inner member first arm and a U-shaped channel section having first and second legs joined by a bridge formed from the inner member, said first leg depending from the inner member first arm second edge, the second leg extending toward the inner member first arm parallel to and spaced adjacent to the first extension, said second extension being positioned between the second leg and said inner member first arm wherein said inner member, said channel section and said extensions cooperate to form said third chamber.

9. The joint construction of claim 8 wherein the fourth chamber is constructed from the second arm and second projection of the respective inner and outer members in mirror image relation to said third chamber.

10. The joint construction of claim 8 including an enclosure side wall having a major planar portion extending in said given direction and a planar first flange normal to said major portion, said first flange being located between the first extension and said second leg, said major planar portion being juxtaposed with said bridge of said third chamber and further including at least one fastener for securing said major portion to said bridge wherein the at least one fastener is in communication with said third chamber and isolated from the first chamber.

11. The joint construction of claim 10 including a top wall having a major planar portion and a planar second flange normal to said top wall major planar portion, said inner and outer members having a first set of respective further edges normal to said first and second edges forming a third top end of said second chamber and a second set of further edges distal the first set of edges and normal to said first and second edges forming a fourth bottom end of said second chamber, said top wall overlying the third top end at said first set of edges for enclosing said third end, said planar second flange overlying the outer member at said second, third and fourth chambers and further including at least one further fastener for securing said planar second flange to at least one of said outer member at said second chamber and said inner member at said bridge whereby said at least one further fastener is in fluid isolation from said first chamber.

12. The joint construction of claim 10 wherein the first projection of the outer member lies in a first plane and the bridge of the U-shaped section of the inner member lies in a second plane offset from the first plane an amount sufficient so that the planar major portion of the enclosure side wall is substantially coplanar with the outer member first projection.

* * * * *